US008372521B2

(12) United States Patent
Watanabe

(10) Patent No.: US 8,372,521 B2
(45) Date of Patent: Feb. 12, 2013

(54) TWISTED WIRE AND METHOD OF PRODUCING TWISTED WIRE

(75) Inventor: Daisuke Watanabe, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/461,016

(22) Filed: May 1, 2012

(65) Prior Publication Data

US 2012/0227857 A1 Sep. 13, 2012

Related U.S. Application Data

(62) Division of application No. 12/410,172, filed on Mar. 24, 2009, now Pat. No. 8,182,930.

(30) Foreign Application Priority Data

Mar. 25, 2008 (JP) ..... 2008-077042

(51) Int. Cl.
*B21D 3/12* (2006.01)
*H01B 13/02* (2006.01)
*F23Q 7/00* (2006.01)

(52) U.S. Cl. ..... 428/592; 72/135; 72/183; 140/103; 29/461

(58) Field of Classification Search ..... 72/135, 72/138, 183; 140/103; 428/592, 606; 29/461
See application file for complete search history.

(56) References Cited

U.S. PATENT DOCUMENTS 4,889,496 A 12/1989 Neidich
5,051,108 A 9/1991 Lincoln
5,388,998 A 2/1995 Grange et al.
6,043,666 A 3/2000 Kazama
6,712,826 B2 3/2004 Lui
6,729,026 B2 5/2004 Garcia et al.
8,006,529 B2 8/2011 Defranks et al.
8,182,930 B2 * 5/2012 Watanabe ..... 72/183

FOREIGN PATENT DOCUMENTS

JP 59-29922 A 2/1984
JP 2007-220378 A 8/2007
JP 2007-227185 A 9/2007

OTHER PUBLICATIONS

Office Action issued by the P.R. of China in the corresponding Chinese Patent Application No. 200910129495.7.

* cited by examiner

*Primary Examiner* — David B Jones
(74) *Attorney, Agent, or Firm* — Sughrue Mion, PLLC

(57) ABSTRACT

A method for producing a twisted wire (1) by twisting two wires (2) together. When that portion of the twisted wire (1) extending from one ends (3) of the two wires (2) to a first predetermined position (4) is defined as a one end-side twisted portion (5), and that portion of the twisted wire (1) extending from the first predetermined position (4) to a second predetermined position (6) is defined as an intermediate twisted portion (7), and that portion of the twisted wire (1) extending from the second predetermined position (6) to the other ends (8) of the two wires (2) is defined as an other end-side twisted portion (9), a twisting pitch of the one end-side twisted portion (5) and the other end-side twisted portion (9) is smaller than a twisting pitch of the intermediate twisted portion (7).

2 Claims, 3 Drawing Sheets

TWISTED WIRE AND METHOD OF PRODUCING TWISTED WIRE

This is a divisional of U.S. application Ser. No. 12/410,172 filed Mar. 24, 2009, the disclosure of which is incorporated herein by reference in its entirety.

BACKGROUND OF THE INVENTION

1. Field of the Invention

This invention relates to a twisted wire (twisted pair wire) comprising two wires twisted together and a method of producing the twisted wire.

2. Description of the Related Art

A twisted wire is the type of wire (or cable) which can suppress the generation of electromagnetic waves and is formed by twisting two wires together (see, for example, Patent Literatures 1 and 2).

Patent Literature 1: JP-A-2007-220378

Patent Literature 2: JP-A-2007-227185

Each of the conventional twisted wires disclosed in Patent Literatures 1 and 2 is such that its twisted condition is maintained even after it is removed from a production apparatus. In actual use, however, there are occasions when a vinyl tape or the like is wound around twisted opposite end portions of the twisted wire as safety measures, that is, in order to positively maintain the predetermined twisted condition. With respect to maintaining the twisted condition by the use of the tap or the like, time and labor required for the production of the twisted wire are increased at least by the addition of the tape winding operation, and besides the tape need to be prepared, and therefore this leads to an increased cost of the twisted wire, which is a problem to be solved.

SUMMARY OF THE INVENTION

This invention has been made in view of the above circumstances, and an object of the invention is to provide a twisted wire and a twisted wire production method, in which a predetermined twisted condition of the twisted wire can be maintained without using any secondary member.

The above object of the invention has been achieved by a twisted wire of a first aspect of the invention characterized in that a twisting pitch of opposite end portions of the twisted wire is smaller than a twisting pitch of an intermediate portion of the twisted wire.

In the invention having the above feature, the opposite end portions of the twisted wire which have the small twisting pitch and will not easily get loose are formed. Therefore, the predetermined twisted condition of the twisted wire is maintained without using any secondary member.

A twisted wire production method of a second aspect of the invention, wherein wires to be twisted together are arranged side by side, and a moving member is moved from one ends of the arranged wires toward the other ends thereof, so that the wires are twisted together between the moving member and the one ends, and also a twist of the wires is removed between the moving member and the other ends of the wires, is characterized in that when that portion of the twisted wire extending from the one ends to a first predetermined position is defined as a one end-side twisted portion, and that portion of the twisted wire extending from the first predetermined position to a second predetermined position is defined as an intermediate twisted portion, and that portion of the twisted wire extending from the second predetermined position to the other ends is defined as an other end-side twisted portion, a speed of movement of the moving member is lower at the one end-side twisted portion and the other end-side twisted portion than at the intermediate twisted portion, or a speed of twisting of the wires together is higher at the one end-side twisted portion and the other end-side twisted portion than at the intermediate twisted portion.

In the invention having the above features, by varying (controlling) the speed of movement of the moving member (that is, by making the movement speed lower) or by making the twisting speed higher, the portions of the twisted wire which have the small twisting pitch and will not easily get loose are formed. The portions which will not easily get loose are formed respectively at the opposite end portions of the twisted wire. The thus produced twisted wire is kept in the predetermined twisted condition without using any secondary member.

In the invention, in the case of varying (controlling) the speed of movement of the moving member, a control of a production apparatus itself can be effected easily. On the other hand, in the case of varying the twisting speed, the twisted wire can be produced at a constant speed.

A twisted wire production method of a third aspect of the invention, wherein with a rotary member disposed at a twist front end position or a twist start position defined in a twisting operation, one of wires to be twisted together, while twisted in a predetermined direction, is fed toward the twist start position, and also the other of the wires, while twisted in the predetermined direction, is fed toward the twist start position, and the twisting operation is effected by the twisting of each of the wires and an action of the rotary member, is characterized in that when that portion of the twisted wire extending from the twist front end position or the twist start position to a first predetermined position is defined as a one-end side twisted portion, and that portion of the twisted wire extending from the first predetermined position to a second predetermined position is defined as an intermediate twisted portion, and that portion of the twisted wire extending from the second predetermined position to a twist rear end position or a twist finish position is defined as an other end-side twisted portion, a speed of movement of the rotary member is lower at the one end-side twisted portion and the other end-side twisted portion than at the intermediate twisted portion.

In the invention having the above features, by varying (controlling) the speed of movement of the rotary member, the portions of the twisted wire which will not easily get loose are formed. The portions which have the small twisting pitch and will not easily get loose are formed respectively at the opposite end portions of the twisted wire. The thus produced twisted wire is kept in the predetermined twisted condition without using any secondary member.

In the first to third aspects of invention, there is achieved an advantage that the predetermined twisted condition can be maintained without using any secondary member. In the invention, since any secondary member is not used, the cost of the twisted wire itself can be reduced.

BRIEF DESCRIPTION OF THE DRAWINGS

FIG. 1A is the schematic view of the twisted wire of the invention, and FIG. 1B is the schematic view of a twisted wire production apparatus operated in accordance to the twisted wire production method of the invention.

FIG. 2A is the schematic view of the twisted wire of the invention, and FIG. 2B is the schematic view of a twisted wire production apparatus operated in accordance to the twisted wire production method of the invention.

DESCRIPTION OF THE PREFERRED EMBODIMENTS

Figure 1:
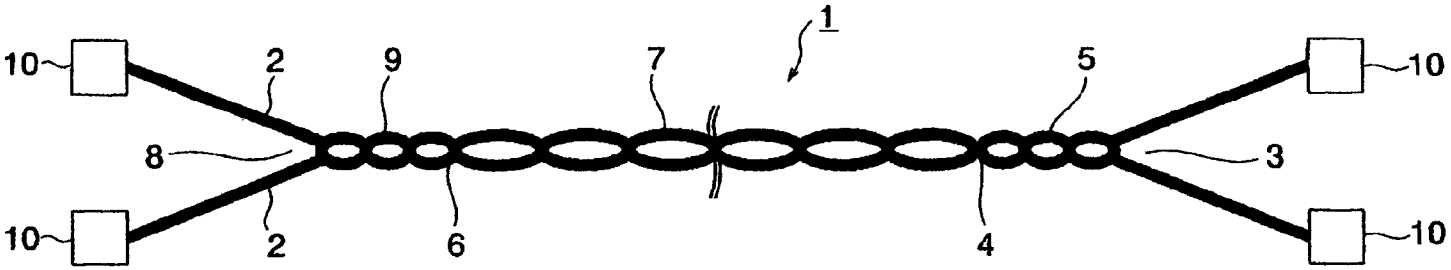
FIGS. 1A and 1B are views showing a twisted wire and a twisted wire production method according to one preferred embodiment of the present invention.
Figure 1:
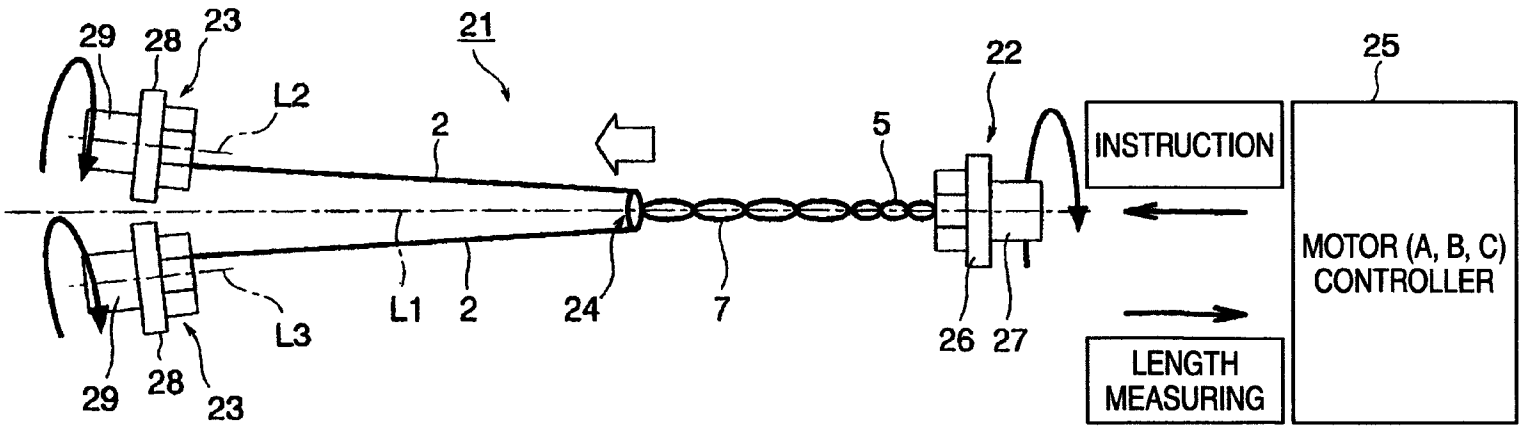

FIGS. 1A and 1B show a twisted wire and a twisted wire production method according to one preferred embodiment of the invention, and FIG. 1A is a schematic view of the twisted wire of the invention, and FIG. 1B is a schematic view of a twisted wire production apparatus operated in accordance to the twisted wire production method of the invention. FIGS. 2A and 2B show a twisted wire and a twisted wire production method according to another embodiment of the invention, and FIG. 2A is a schematic view of the twisted wire of the invention, and FIG. 2B is a schematic view of a twisted wire production apparatus operated in accordance to the twisted wire production method of the invention. FIG. 3 is a flow chart with respect to operations of motors.

In FIG. 1A, reference numeral 1 denotes the twisted wire (twisted pair wire) of the invention. The twisted wire 1 is formed by twisting two wires 2 together. When that portion of the twisted wire 1 extending from one end portions 3 of the two wires 2 to a first predetermined position 4 is defined as a one end-side twisted portion 5, and that portion of the twisted wire 1 extending from the first predetermined position 4 to a second predetermined position 6 is defined as an intermediate twisted portion 7, and that portion of the twisted wire 1 extending from the second predetermined position 6 to the other end portions 8 of the two wires 2 is defined as an other end-side twisted portion 9, a twisting pitch of each of the one end-side twisted portion 5 and the other end-side twisted portion 9 is smaller (for example, not larger than 12 mm) than a twisting pitch of the intermediate twisted portion 7.

By thus making the twisting pitch of the one end-side twisted portion 5 and the other end-side twisted portion 9 small, the intermediate twisted portion 7 can be kept in a predetermined twisted condition. By thus making the twisting pitch of the one end-side twisted portion 5 and the other end-side twisted portion 9 small, the portions that will not easily get loose can be formed at the twisted wire 1 (There is no need to use any secondary member such as a tape.).

The two wires 2 are ordinary electric wires designed particularly for use as a twisted pair wire (or cable), and have a predetermined length. Terminals 10 are provided at the opposite ends of the two wires 2, respectively. In this embodiment, the twisted wire 1 is produced using the wires 2 having the respective terminals 10 beforehand secured thereto, although the invention is not particularly limited to this form.

In FIG. 1B, reference numeral 21 denotes the twisted wire production apparatus operated in accordance to the twisted wire production method of the invention. The twisted wire production apparatus 21 is designed to produce the twisted wire 1 of the invention, and comprises a one end-side rotary member 22, a pair of other end-side rotary members 23, a moving member 24 movable from the one end-side rotary member 22 toward the other end-side rotary members 23, and a motor controller 25 for controlling the operations of these members (Here, only the main constituent portions of the apparatus will be described.). In the twisted wire production apparatus 21, the two wires 2 are twisted together between the one end-side rotary member 22 and the moving member 24, and also a twist of each of the two wires 2 is removed between the moving member 24 and the corresponding other end-side rotary member 23. The construction of the above apparatus will be described below with reference to FIGS. 1A and 1B.

The one end-side rotary member 22 comprises a chuck portion 26 for holding (chucking) the terminals 10 secured respectively to the one end portions 3 of the two wires 2, a motor 27 (motor A) for rotating the chuck portion 26 about a center axis L1 in a predetermined direction, and a support member (not shown) supporting the chuck portion 26 and the motor 27. A rotational speed (number of revolutions), etc., of the motor 27 are controlled by the motor controller 25.

The pair of other end-side rotary members 23 comprise respective chuck portions 28 for respectively holding the terminals 10 secured respectively to the other end portions 8 of the two wires 2, motors 29 (motors B) for respectively rotating the chuck portions 28 about respective center axes L2 and L3 (inclined at a predetermined angle relative to the center axis L1) in a predetermined direction (that is, for rotating the chuck portions 28 in the same direction as the direction of rotation of the chuck portion 26 of the one end-side rotary member 22), and support members (not shown) supporting the chuck portions 28 and the motors 29. A rotational speed, etc., of each motor 29 are controlled by the motor controller 25.

Although not particularly shown in the drawings, the moving member 24 comprises a moving member body, a support member supporting this moving member body, a rail provided parallel to the center axis L1 so as to guide the movement of the moving member body, and a motor (motor C) for moving the moving member body toward the other end portions 8 of the two wires 2. A rotational speed, etc., of the motor C are controlled by the motor controller 25. By controlling the rotational speed of the motor C, the speed of movement of the moving member 24 is controlled. The moving member 24 is of such a construction that the moving member body will not rotate, but is merely moved toward the other end portions 8. For example, the moving member body is of the split type which can be slit into halves, and insertion holes for the passage of the two respective wires 2 therethrough are formed in split portions of the moving member body. The insertion holes have such a diameter as not to affect the twisting of the wires 2 and the removal of the twist thereof.

In this embodiment, the motor 27 (motor A) of the one end-side rotary member 22 and the motors 29 of the other end-side rotary members 23 are so controlled by the motor controller 25 as to rotate at the same rotational speed (a predetermined rotational speed). On the other hand, the motor (motor C) of the moving member 24 is so controlled by the motor controller 25 that the rotational speed thereof will not be kept constant so as to vary the speed of movement of the moving member 24.

Next, on the basis of the above construction, the production of the twisted wire 1 will be described with reference to the flow chart of FIG. 3.

When the production of the twisted wire 1 is to be started, the moving member 24 is set in the vicinity of the one end-side rotary member 22. When the production of the twisted wire 1 is started (Step S1), first, a twisting operation for forming the one end-side twisted portion 5 is effected (Step 2). At this time, the speed of movement of the moving member 24 is low, so that the twisted portion 5 which has the small twisting pitch and will not easily get loose is formed. The formation of the one end-side twisted portion 5 is effected to the first predetermined position 4 while measuring its length by the motor controller 25 (Step S3).

When the moving member 24 reaches the first predetermined position 4, thus completing the formation of the one end-side twisted portion 5 (YES at Step S3), the twisting pitch is changed (Step S4), and a twisting operation for forming the intermediate twisted portion 7 is effected (Step S5). At this time, the speed of movement of the moving member 24 becomes high, so that the twisted portion with the predetermined twisting pitch determined by this moving speed is formed. The formation of the intermediate twisted portion 7 is effected to the second predetermined position 6 while measuring its length (Step S6) as described above.

When the moving member 24 reaches the second predetermined position 6, thus completing the formation of the intermediate twisted portion 7 (YES at Step S6), the twisting pitch is again changed (Step S7), and a twisting operation for forming the other end-side twisted portion 9 is effected (Step S8). At this time, the speed of movement of the moving member 24 becomes low, so that the twisted portion which has the small twisting pitch and will not easily get loose is formed. When the formation of the other end-side twisted portion 9 is completed, the production of the twisted wire 1 is finished (Step S9).

The twisted wire 1 removed from the twisted wire production apparatus 21 has the twisted portions of the small twisting pitch formed respectively at its opposite ends thereof, and therefore the twisted wire 1 is kept in the predetermined twisted condition without using any secondary member such as a tape. Such a secondary member is not used in the twisted wire 1, the cost of the twisted wire 1 is not increased.

In the above embodiment, the motor 27 (motor A) of the one end-side rotary member 22 and the motors 29 (motors B) of the other end-side rotary members 23 are kept at the constant rotational speed (predetermined speed), while the rotational speed of the motor (motor C) of the moving member 24 is varied. However, the invention is not limited to this construction, and the motors may be controlled in such a manner that the speed of movement of the moving member 24 is kept constant, while the twisting speed is varied (In the case where the speed of twisting of the one end-side twisted portion 5 and the other end-side twisted portion 9 is higher than the speed of twisting of the intermediate twisted portion 7, the twisted wire 1 having the same construction as described above can be obtained.).

Next, the twisted wire and the twisted wire production method according to the other embodiment of the invention will be described. The twisted wire 1 shown in FIG. 2A has the same construction as that of the twisted wire 1 shown in FIG. 1A, and the identical portions of the twisted wire will be designated by identical reference numerals, respectively.

Figure 2:
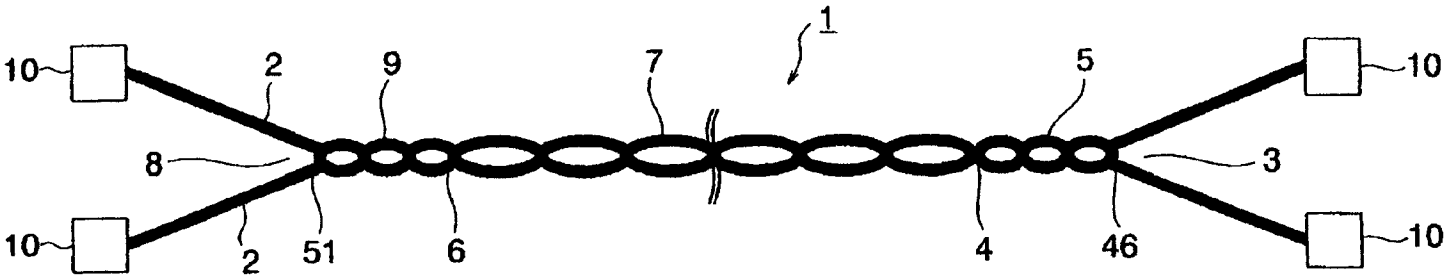
FIGS. 2A and 2B are views showing a twisted wire and a twisted wire production method according to another embodiment of the invention.
Figure 2:
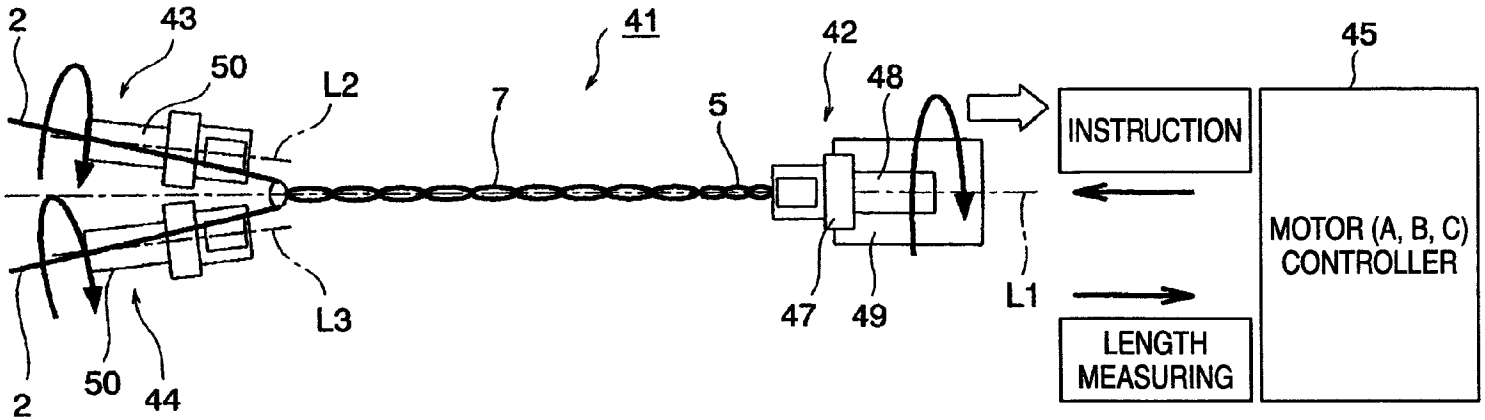
Figure 3:
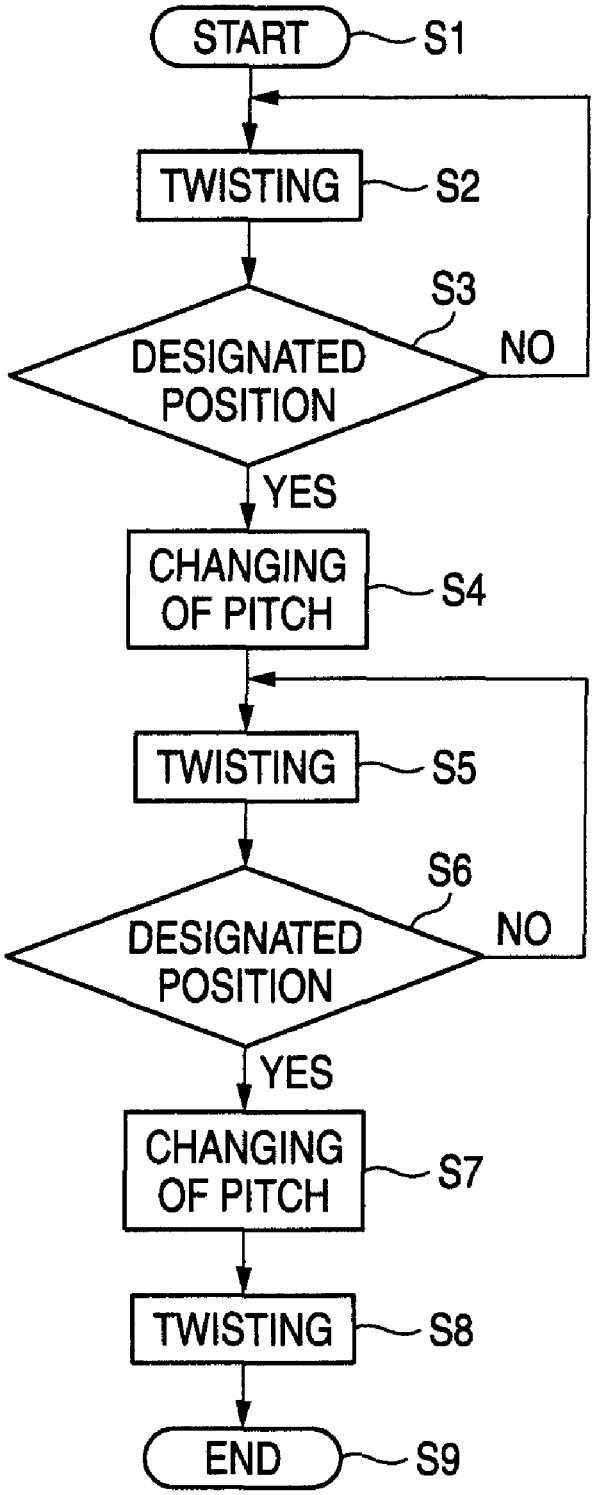
FIG. 3 is a flow chart with respect to operations of motors.

In FIG. 2, a twisted wire production apparatus 41 according to the other embodiment of the invention is designed to produce the twisted wire (twisted pair wire) 1 by twisting two wires 2 together. This apparatus 41 comprises a rotary member 42, a first twisting feed mechanism 43, a second twisting feed mechanism 44, and a motor controller 45 for controlling the operations of these members (Here, only the main constituent portions of the apparatus are described.). The twisted wire production apparatus 41 is constructed such that with the rotary member 42 disposed at a twist start position (a twist front end position 46) defined in the twisting operation, one of the two wires 2, while twisted in a predetermined direction, is fed, and also the other of the two wires 2, while twisted in the predetermined direction, is fed, and the twisting operation is effected by the twisting of each of the two wires 2 and the rotation and movement (that is, action) of the rotary member 42. The construction of the above apparatus will be described below with reference to FIGS. 2A and 2B.

The rotary member 42 is removably mounted at the twist front end position 46. The rotary member 42 can hold (chuck) the two wires 2 at the twist front end position 46, and can rotate and move together with the twisted portion. The rotary member 42 comprises a chuck portion 47, a motor 48 (motor A) for rotating the chuck portion 47 about a center axis L1 in a predetermined direction, and a support-cum-moving member 49 for supporting the chuck portion 47 and the motor 48. Although not particularly shown in the drawings, the support-cum-moving member 49 is provided with a motor (motor C), and can be moved along a rail (provided parallel to the center axis L1) by this motor (motor C). A rotational speed, etc., of each of the motor 48 and the motor C (not shown) are controlled by the motor controller 45.

The first twisting feed mechanism 43, while twisting one of the two wires 2 in a predetermined direction (the same direction as the direction of rotation of the rotary member 42), can feed the one wire 2 (in the direction of movement of the rotary member 42). The first twisting feed mechanism 43 includes one or two motors 50 (motor B) for effecting the above twisting and feeding operation. The rotational speed, etc., of the motor 50 are controlled by the motor controller 45.

The second twisting feed mechanism 44, while twisting the other of the two wires 2 in a predetermined direction (the same direction as the direction of rotation of the rotary member 42), can feed the other wire 2 (in the direction of movement of the rotary member 42). In this embodiment, the second twisting feed mechanism 44 is identical in construction, structure and positional relation to the first twisting feed mechanism 43. The first twisting feed mechanism 43 and the second twisting feed mechanism 44 are controlled in synchronism with each other. The first and second twisting feed mechanisms 43 and 44 are arranged such that their center axes L2 and L3 are inclined at a predetermined angle relative to the center axis L1.

In this embodiment, the motor 48 (motor A) of the rotary member 42 is so controlled by the motor controller 45 as to rotate at a constant rotational speed. Also, each of the first twisting feed mechanism 43 and the second twisting feed mechanism 44 is so controlled by the motor controller 45 as to rotate at a constant speed. On the other hand, the motor (motor C which is not shown) of the rotary member 42 is so controlled that its rotational speed will not be kept constant so as to vary the speed of movement of the moving member 42.

Next, on the basis of the above construction, the production of the twisted wire 1 of the other embodiment will be described with reference to the flow chart of FIG. 3.

When the production of the twisted wire 1 is to be started, the rotary member 42 is set at the twist start position (the twist front end position 46). When the production of the twisted wire 1 is started (Step S1), first, the rotary member 42 is rotated and moved. As a result, a twisting operation is effected to form a one end-side twisted portion 5 (Step 2). At this time, the speed of movement of the rotary member 42 is low, so that the twisted portion 5 which has a small twisting pitch and will not easily get loose is formed. The formation of the one end-side twisted portion 5 is effected to a first predetermined position 4 while measuring its length by the motor controller 45 (Step S3).

When the formation of the one end-side twisted portion 5 is completed (YES at Step S3), a twisting pitch is changed (Step S4), and then a twisting operation for forming an intermediate twisted portion 7 is effected (Step S5). At this time, the speed of movement of the rotary member 42 becomes high, so that the twisted portion with the predetermined twisting pitch determined by this moving speed is formed. The formation of the intermediate twisted portion 7 is effected to a second predetermined position 6 while measuring its length (Step S6).

When the formation of the intermediate twisted portion 7 is completed (YES at Step S6), a twisting pitch is again changed (Step S7), and a twisting operation for forming an other end-side twisted portion 9 is effected (Step S8). At this time, the speed of movement of the rotary member 42 becomes low, so that the twisted portion which has a small twisting pitch and will not easily get loose is formed. When the twisting is effected to a twist finish position (twist rear end position 51), thus completing the formation of the other end-side twisted portion 9, the production of the twisted wire 1 of the other embodiment is finished (Step S9).

The twisted wire 1 removed from the twisted wire production apparatus 41 has the twisted portions of the small twisting pitch formed respectively at its opposite ends thereof, and therefore the twisted wire 1 is kept in the predetermined twisted condition without using any secondary member such as a tape. Since such a secondary member is not used in the twisted wire 1, the cost of the twisted wire 1 is not increased.

With respect to a supplementary explanation of the advantageous effects of the present invention described above, when a multiplex operation in a vehicle increases, the amount of twisted wires contained in a wire harness increases. Particularly, the amount of twisted wires used as a medium for a CAN communication increases rapidly, and it is very important to control the characteristics of the product in order to enable a safety travel of the vehicle. Therefore, the present invention is useful in view of this background.

In the present invention, various modifications can be made without departing from the subject matter of the invention.

What is claimed is:

1. A twisted wire production method comprising:

arranging at least two wires with opposite end portions to be twisted together side by side, moving a moving member from one end portion of the wires toward the other end portion of the wires, to twist the wires together between the moving member and the one end, and to remove a twist of the wires between the moving member and the other end of the wires; wherein:

when a portion of the twisted wire that extends from the one end portion to a first predetermined position is defined as a one end-side twisted portion, and a portion of the twisted wire that extends from the first predetermined position to a second predetermined position is defined as an intermediate twisted portion, and a portion of the twisted wire that extends from the second predetermined position to the other end portion is defined as another end-side twisted portion, lowering a speed of movement of the moving member at the one end-side twisted portion and the other end-side twisted portion than at the intermediate twisted portion, or raising a speed of twisting of the wires together at the one end-side twisted portion and the other end-side twisted portion than at the intermediate twisted portion, wherein a twisting diameter of the one end-side twisted portion and the other end-side twisted portion is substantially the same as a twisting diameter of the intermediate twisted portion with respect to a longitudinal axis of the twisted wire.

2. A twisted wire production method comprising:

disposing a rotary member at a twist front end position or a twist start position defined in time of twisting operation, feeding one of wires to be twisted together toward the twist start position while twisted in a predetermined direction, and feeding the other of the wires toward the twist start position while twisted in the predetermined direction, and effecting the twisting operation by the twisting of each of the wires and an action of the rotary member; wherein:

when a portion of the twisted wire that extends from the twist front end position or the twist start position to a first predetermined position is defined as a one-end side twisted portion, and a portion of the twisted wire that extends from the first predetermined position to a second predetermined position is defined as an intermediate twisted portion, and a portion of the twisted wire that extends from the second predetermined position to a twist rear end position or a twist finish position is defined as an other end-side twisted portion, lowering a speed of movement of the rotary member at the one end-side twisted portion and the other end-side twisted portion than at the intermediate twisted portion, wherein a twisting diameter of the one end-side twisted portion and the other end-side twisted portion is substantially the same as a twisting diameter of the intermediate twisted portion with respect to a longitudinal axis of the twisted wire.

* * * * *